United States Patent [19]

Aono et al.

[11] Patent Number: 4,791,042

[45] Date of Patent: Dec. 13, 1988

[54] EPOXY HARDENER IN DYE FIXING ELEMENT

[75] Inventors: Toshiaki Aono; Takeshi Shibata, both of Kanagawa, Japan

[73] Assignee: Fuji Photo Film Co., Ltd., Kanagawa, Japan

[21] Appl. No.: 919,116

[22] Filed: Oct. 15, 1986

[30] Foreign Application Priority Data

Oct. 18, 1985 [JP] Japan ..... 60-231093

[51] Int. Cl.[4] ..... G03C 5/54; G03C 1/90

[52] U.S. Cl. ..... 430/203; 430/213; 430/262

[58] Field of Search ..... 430/203, 213, 624, 262

[56] References Cited

U.S. PATENT DOCUMENTS

| | | | |
|---|---|---|---|
| 3,047,394 | 7/1962 | Allen et al. | 430/624 |
| 3,091,537 | 5/1963 | Barness | 430/624 |
| 4,636,455 | 1/1987 | Aono et al. | 430/203 |
| 4,665,005 | 5/1987 | Aono et al. | 430/203 |
| 4,678,735 | 7/1987 | Kitaguchi et al. | 430/203 |

FOREIGN PATENT DOCUMENTS

| | | |
|---|---|---|
| 119615A | 9/1984 | European Pat. Off. . |
| 122512A | 10/1984 | European Pat. Off. . |

*Primary Examiner*—Richard L. Schilling

*Attorney, Agent, or Firm*—Sughrue, Mion, Zinn, Macpeak & Seas

[57] ABSTRACT

A process for forming an image comprising imagewise exposing a light-sensitive element comprising a support having thereon at least a light-sensitive silver halide, a binder, and a dye providing substance which produces or releases a mobile dye corresponding or counter-corresponding to a reaction where said light-sensitive silver halide is reduced to silver at an elevated temperature, and subsequently or simultaneously heating said light-sensitive element in the presence of at least one of a base and precursor thereof, and thereby transferring said mobile dye thus produced or released to a dye fixing element, wherein a coated layer of said dye fixing element has been hardened with an epoxy hardener.

20 Claims, No Drawings

EPOXY HARDENER IN DYE FIXING ELEMENT

FIELD OF THE INVENTION

The present invention relates to a process for forming a color image by heating.

BACKGROUND OF THE INVENTION

Being excellent in photographic properties such as sensitivity and gradation as compared to other photographic processes such as electrophotography and a diazo process, a photographic process using silver halide has been most widely used. In recent years, a technique for providing images in a rapid and simple manner has been developed by changing the image formation process of light-sensitive materials using silver halides from a wet process using, e.g., a conventional developer to a dry process, e.g., by heating.

A heat-developable light-sensitive material is known in the art. Examples of the heat-developable light-sensitive material and its process are described in *SHASHIN-KOGAKU NO KISO* (Fundamentals of Photographic Engineering) (published by Corona, pp. 553–555, 1977), *EIZO JOHO* (Image Information) (published in April 1978, page 401), *Handbook of Photography and Reprography* (edited by Neblets, 7th edition, pp. 32–33, published by Van Nostrand Reinhold Company), U.S. Pat. Nos. 3,152,904, 3,301,678, 3,392,020 and 3,457,075, British Pat. Nos. 1,131,108 and 1,167,777, and *Research Disclosure,* RD No. 17029 (June 1978, pp. 9–15).

Examples of a process for obtaining color images by heating are proposed in *Research Disclosure,* RD No. 16966 (May 1978, pp. 54–58), *Research Disclosure,* RD No. 14433 (April 1976, pp. 30–32), U.S. Pat. Nos. 3,985,655, 4,463,079, 4,474,867, 4,478,927, 4,507,380, 4,500,626 and 4,483,914. All these processes are designed to produce or release a dye, thereby forming an imagewise distribution of the dye. These processes are characterized in that they can provide an imagewise distribution of the dye in a short period of time.

In a process which comprises heating the light-sensitive element in the presence of at least one of a base and a base precursor (abridged "a base and/or base precursor") to form an imagewise distribution of a mobile dye, and transferring and fixing the imagewise distribution of a mobile dye to a dye fixing element, the heat development and the dye transfer may be effected simultaneously or in succession, or the two processes may be separately effected. It is desired that the speed of development and transfer be further increased in the former case and the speed of transfer be further increased in the latter case in order to obtain an imagewise distribution of a dye in a short period of time.

If a base and/or base precursor is incorporated in the dye fixing element, a binder used in the dye fixing element such as gelatin decomposes when acted upon by the base with the passage of time. As a result, when the dye fixing element is peeled off the light-sensitive element, the coated layer of the dye fixing element is peeled off.

SUMMARY OF THE INVENTION

It is therefore an object of the present invention to provide a process which enables formation of color images in a shorter period of time.

It is another object of the present invention to provide a process which enables formation of color images of lower minimum color density and higher maximum color density.

It is a further object of the present invention to provide a process which makes it possible to peel a dye fixing element off a light-sensitive element without peeling of the layer even if a base and/or base precursor is incorporated in said dye fixing element.

These and other objects of the present invention will become more apparent from the following detailed description and examples.

These objects of the present invention are accomplished by a process for forming an image comprising imagewise exposing a light-sensitive element comprising a support having thereon at least a light-sensitive silver halide, a binder, and a dye providing substance which produces or releases a mobile dye corresponding or counter-corresponding to a reaction where said light-sensitive silver halide is reduced to silver at an elevated temperature, and subsequently or simultaneously heating said light-sensitive element in the presence of at least one of a base and precursor thereof, and thereby transferring said mobile dye thus produced or released to a dye fixing element, wherein a coated layer of said dye fixing element has been hardened with an epoxy hardener.

DETAILED DESCRIPTION OF THE INVENTION

The epoxy hardeners to be used in the present invention are not specifically limited. For example, compounds described in U.S. Pat. Nos. 3,047,394 and 3,189,459, West German Pat. No. 1,085,663, and Japanese patent publication No. 26890/79 can be used in the present invention.

A compound having at least two epoxy portions can be used in the present invention. Such compound is preferably represented by formula (I)

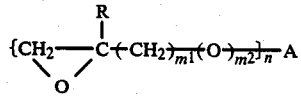

(I)

wherein R represents a hydrogen atom or a lower alkyl group, preferably represents a hydrogen atom; $m^1$ and $m^2$ each represents an integer of 0 or 1; n represents an integer of 2 to 4; and A represents a group having a valency of n, with the proviso that when n is 2, A is a group having a valency of 2 or a mere bond.

Specific examples of the compound represented by formula (I) are shown hereinafter. In these structural formulae, $E^0$, $E^1$, and $E^2$ represent

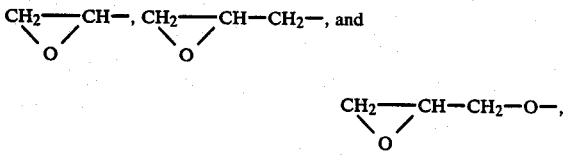

respectively. In the structural formulae (1) to (4), (11), (12), and (29), p represents an integer of 1 to 13.

$$E^2(CH_2)_pOCH_2E^1 \quad (1)$$
$$E^2CH(CH_3)(CH_2)_pE^2 \quad (2)$$
$$E^2(CH_2CH_2O)_pE^1 \quad (3)$$
$$E^2\{(CHCCH_3)CH_2O\}_pE^1 \quad (4)$$
$$E^2CH_2C(CH_3)_2CH_2E^2 \quad (5)$$
$$E^2CH(CH_3)CH_2OCH_2CH(CH_3)OE^0 \quad (6)$$

-continued (7)

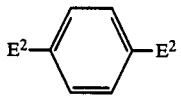

(8)

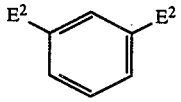

(9)

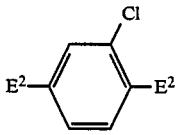

(10)

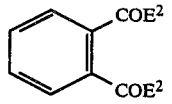

(11) $E^0(CH_2)_pE^0$

(12) $E^2CONH(CH_2)_pNHCOE^1$ (13)

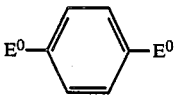

(14) $CH_2(E^2)CH(E^2)CH_2(E^2)$

(15) $CH_2(E^2)CH(OH)CH_2(E^2)$

(16) $CH_2(OH)C(C_2H_5)(CH_2E^2)_2$

(17) $C(C_2H_5)(CH_2E^2)_3$

(18) $C(CH_2OH)_2(CH_2E^2)_2$

(19) $C(CH_2OH)(CH_2E^2)_3$

(20) $E^2CH_2(OH)CH_2CH(OH)CH_2OCH_2CH(CH_2)(OCH_2E^2)$

(21) $E^2CH_2CH(E^2)CH(OH)CH(E^2)CH(OH)CH_2E^2$ (22)

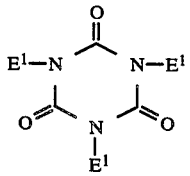

(23)

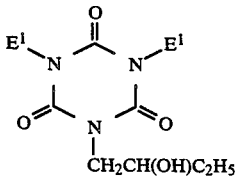

(24)

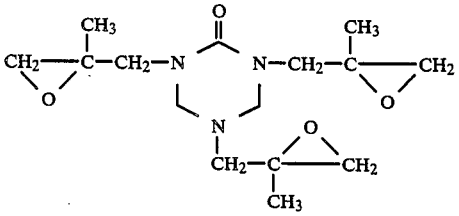

(25)

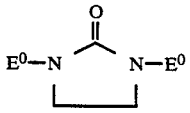

-continued (26)

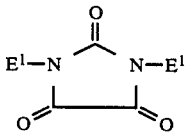

(27)

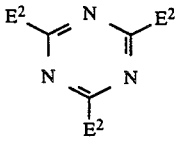

(28) $O{=}P(E^2)_3$

(29) $E^2(CH_2)_pOCH_2E^0$

The compounds represented by formula (I) may be used singly or in combination of two or more in the present invention. Alternatively, these compounds may be used in combination with other known hardeners.

The amount of the epoxy hardener to be used in the present invention is preferably from 0.01 to 20% by weight, more preferably from 0.1 to 10% by weight based on the amount of the binder to be hardened (such as dry gelatin). If the dye fixing element contains a multilayer construction as described hereinafter, any one of these layers may contain such a hardener. For example, any one of, two or more of, or all of the dye fixing layer, protective layer, water absorbing layer, white reflective layer, etc. can be hardened by the epoxy hardener of the present invention. If the base and/or base precursor to be used in the present invention is incorporated in a layer in the dye fixing element, at least the layer has been preferably hardened by the epoxy hardener of the present invention. If the layer has an adjacent hydrophilic colloidal layer, the adjacent layer has preferably been hardened by the epoxy hardener of the present invention.

The base and/or base precursor to be used in the present invention may be incorporated in any layer of the light-sensitive element and/or the dye fixing element. If a process in which water is supplied to the light-sensitive element during heat development is employed, the base and/or base precursor may be incorporated in the water.

Examples of the base which may be used in the present invention include inorganic bases such as hydroxide, carbonate, bicarbonate, borate, secondary or tertiary phosphate, quinolinate, and metaborate of alkali metals, alkaline earth metals, and tertiary alkylammonium, and organic bases such as aliphatic amines (e.g., a trialkylamine, a hydroxylamine, and an aliphatic polyamine), aromatic amines (e.g., an N-alkyl-substituted aromatic amine, an N-hydroxyalkyl-substituted aromatic amine, and a bis(p-(dialkylamino)phenyl)methane), heterocyclic amines, amidines, cyclic amidines, guanidines, and cyclic guanidines. In particular, those having a pKa of 8 or more are preferably used in the present invention.

Alternatively, salts of the above organic bases and weak acids such as carbonate, bicarbonate, borate, secondary or tertiary phosphate, quinolinate, acetate, and metaborate may be preferably used in the present invention. Besides the above compounds, those described in Japanese patent application (OPI) No. 218443/84 may be preferably used (the term "OPI" used herein refers to a "published unexamined Japanese patent application").

As the base precursor used in the present invention there may be preferably used a compound which undergoes some reaction upon heating to release a base or a compound which generates a base upon electrolysis. Examples of such a compound include a salt of an organic acid and a base which decomposes upon decarboxylation by heating and a compound which undergoes decomposition upon a reaction such as an intramolecular nucleophilic substitution reaction, a Lossen rearrangement, and a Beckmann rearrangement, by heating to release an amine. Preferred examples of such a base precursor which produces a base upon heating include trichloroacetate as described in British Pat. No. 998,949, α-sulfonylacetate as described in U.S. Pat. No. 4,060,420, propionates as described in Japanese patent application (OPI) No. 180573/84, 2-carboxycarboxamide derivatives as described in U.S. Pat. No. 4,088,496, salts of heat-decomposable acids with organic bases and alkali metals and alkaline earth metals as bases as described in Japanese patent application (OPI) No. 195237/84, hydroxamcarbamates using a Lossen rearrangement as described in Japanese patent application (OPI) No. 168440/84, and aldoximcarbamates which generates nitriles upon heating as described in Japanese patent application (OPI) No. 157637/84. Besides the above compounds, base precursors described in British Pat. No. 998,945, U.S. Pat. No. 3,220,846, Japanese patent application (OPI) No. 22625/75, and British Pat. No. 2,079,480 are useful.

Examples of such a compound which produces a base upon electrolysis include various compounds which undergo electrolytic oxidation such as aliphatic acid salts. By this reaction, carbonates of an alkali metal or an organic base such as guanidines and amidines can be obtained at an extremely high efficiency.

Examples of compounds using electrolytic reduction include nitro compounds, nitroso compounds, nitriles, azo compounds, and azoxy compounds. The reduction of such compounds produces a base such as amines and hydrazines. p-Aminophenols, p-phenylenediamines, and hydrazines may be used not only as a base but also as a color image forming substance directly.

The production of an alkali component by electrolysis of water in the presence of various inorganic bases may be utilized in the present invention.

Besides using the above, some methods and compounds which can be used in the present invention include a process which comprises mixing a slightly soluble metal compound with a compound capable of complexing with metal ions of the metal compound (hereinafter referred to as "complexing compound") to produce a base. Examples of such a slightly soluble metal compound include carbonate, hydroxide, and oxide of zinc, aluminum, calcium, barium, etc. Examples of such a complexing compound are described in detail in *Critical Stability Constants* (edited by A. E. Martell and R. M. Smith, Vol. 4 and Vol. 5, published by Plenum Press). Specific examples of such a complexing compound include salts of an aminocarboxylic acid, an iminodiacetic acid, a pyridylcarboxylic acid, an aminophosphoric acid, a carboxylic acid (such as monocarboxylic acid, dicarboxylic acid, tricarboxylic acid, tetracarboxylic acid, and compounds containing substituents such as phosphono, hydroxy, oxo, ester, amide, alkoxy, mercapto, and alkylthio groups), a hydroxam acid, a polyacrylate, and a polyphosphoric acid with an alkali metal, guanidine, amidine, quarternary ammonium salt, etc.

The slightly soluble metal compound and the complexing compound are preferably separately incorporated in the light-sensitive element and the dye fixing element.

The above mentioned bases and/or base precursors of the present invention may be used singly or in combination.

The base and/or base precursor can be used in a wide range of amounts. If the base and/or base precursor is incorporated in the light-sensitive element and/or dye fixing element, it is preferably used in an amount of 50% by weight or less, more preferably from 0.01 to 40% by weight of each element based on the total weight of the coated layer of light-sensitive element and/or dye fixing element. The base and/or base precursor may be dissolved in water before use. In this case, the concentration of the base and/or base precursor is preferably from 0.005 to 2 mole/l, more preferably from 0.05 to 1 mole/l.

In the present invention, a mobile dye produced or released from a dye providing substance is transferred to a dye fixing element simultaneously with or successively after heat development or after development of a combination of a dye fixing element containing at least one layer which has been hardened by an epoxy hardener with a light-sensitive element in the presence of the above mentioned base and/or base precursor. Accordingly, the light-sensitive material of the present invention comprises a light-sensitive element having on a support at least a light-sensitive layer (I) containing at least a light-sensitive silver halide (and optionally an organic silver salt oxidizing agent and/or a reducing agent), a dye providing substance and a binder, and a dye fixing element having a dye fixing layer (II) which is adapted to receive and fix a mobile dye produced from the light-sensitive layer (I).

The light-sensitive layer (I) and the dye fixing layer (II) may be formed on the same support or separate supports. In the case where the two layers are formed on the same support, the two layers can be peeled off each other. For example, after the light-sensitive material is subjected to imagewise exposure to light, uniform heat development, and transfer process, the dye fixing layer (II) or the light-sensitive layer (I) can be peeled off. If the light-sensitive layer (I) is formed on a support to form a light-sensitive element and the dye fixing layer (II) is formed on another support to form a dye fixing element, the mobile dye can be transferred to the dye fixing layer (II) by subjecting the light-sensitive element to imagewise exposure to light, superimposing the dye fixing element upon it, and heating uniformly the laminate in the presence of water.

The form having the light-sensitive element and the dye fixing element formed on separate supports is roughly divided into two types: one is a peeling type and the other is a non-peeling type. In the former type, after the light-sensitive element is imagewise exposed to light, the light-sensitive element and the dye fixing element are superimposed on each other in such a manner that the coated surface of both the elements are brought into contact with each other. When heat development begins, transfer of a mobile dye begins at the same time. Once a transfer image is formed, the light-sensitive element can be smoothly peeled off the dye fixing element. The support for the dye fixing element can be either opaque or transparent depending on whether the final image is of a reflective type or of a transmission type. If necessary, a white reflective layer may be applied to the support. If the base and/or base precursor is previously incorporated in the dye fixing element, the dye fixing element is preferably formed on a different support from that for the light-sensitive element. In the latter non-peeling type, it is necessary that a white reflective layer should be interposed between the light-sensitive layer in the light-sensitive element and the dye fixing layer in the dye fixing element. This white reflective layer may be formed on either the light-sensitive layer or the dye fixing layer. It is necessary that the support for the dye fixing element should be transparent.

If the light-sensitive element and the dye fixing element are formed on the same support, this form can be said to be a mere light-sensitive material. A typical example of this form is a form which does not require the light-sensitive element to be peeled off the dye fixing element after the formation of the transferred image. In this case, a light-sensitive layer, a dye fixing layer and a white reflective layer are laminated on a transparent or opaque support. Preferred examples of such a form include a lamination in which a transparent or opaque support/a light-sensitive layer/a white reflective layer/a dye fixing layer, a transparent support/a dye fixing layer/a white reflective layer/a light-sensitive layer and the like are arranged in this order.

Another typical example of the form in which the light-sensitive element and the dye fixing element are provided on the same support is a form which requires a part or the entire light-sensitive element to be peeled off the dye fixing element as described in Japanese patent application (OPI) No. 67840/81, Canadian Pat. No. 674,082, and U.S. Pat. No. 3,730,718. In such a type, the peeling off layer is formed in a proper position.

The silver halide which can be used in the present invention include any of silver chloride, silver bromide, silver iodide, silver chlorobromide, silver chloroiodide, silver iodobromide, and silver chloroiodobromide. Specifically, any of silver halide emulsions as described in U.S. patent application No. 793,055 (filed on Oct. 30, 1985), U.S. Pat. No. 4,500,626, and *Research Disclosure* (June 1978; pp. 9–10) can be used.

The silver halide emulsion used in the present invention may be used unripened. In general, however, the present invention is subjected to chemical sensitization before use. Conventional sulfur sensitizations, reduction sensitizations, and noble metal sensitizations can be used singly or in combination of two or more. These chemical sensitization processes can be effected in the presence of a nitrogen-containing heterocyclic compound (see Japanese patent application (OPI) Nos. 126526/83 and 215644/83).

The silver halide emulsion to be used in the present invention may be of either the surface latent image type which forms a latent image mainly on the surface of the particles, or the internal latent image type which forms a latent image mainly inside the particles. A direct reversal emulsion comprising a combination of an internal latent image type emulsion and a nucleating agent may be used.

The amount of the light-sensitive silver halide of the present invention to be applied is from 1 $mg/m^2$ to 10 $g/m^2$ as calculated in terms of amount of silver.

In the present invention, an organic metal salt which is relatively stable to light can be used as an oxidizing agent in combination with the light-sensitive silver halide. In this case, the light-sensitive silver halide and the organic metal salt are required to be kept in contact with or in close proximity to each other.

Such an organic metal salt is effective in the case where a heat-developable light-sensitive material is heat-developed at a temperature of 50° C. or above, preferably 60° C. or above. Particularly preferred among these organic metal salts is an organic silver salt.

Examples of organic compounds which may be used to form the above organic metal salt oxidizing agent include those described in U.S. patent application No. 793,055 (filed on Oct. 30, 1985) and U.S. Pat. No. 4,500,626. Besides the above compounds, silver salts of carboxylic acids containing alkynyl groups such as silver phenylpropiolate as described in Japanese patent application (OPI) No. 113235/85 are useful.

The above organic silver salts may be used in an amount of from 0.01 to 10 mole, preferably from 0.01 to 1 mole based on mole of the light-sensitive silver halide. The total amount of the light-sensitive silver halide and the organic silver salt to be applied is preferably from 50 $mg/m^2$ to 10 $g/m^2$ as calculated in terms of amount of silver.

The silver halide to be used in the present invention may be spectrally sensitized by a methine dye or the like. Examples of such a dye which may be used include a cyanine dye, a melocyanine dye, a complex cyanine dye, a complex melocyanine dye, a holopolar cyanine dye, a hemicyanine dye, a styryl dye, and a hemioxonol dye.

Specific examples of such a dye include sensitizing dyes as described in Japanese patent application (OPI) Nos. 180550/84 and 140335/85 and *Research Disclosure,* RD No. 17029 (June 1978, pp. 12–13) and heat-decolorable sensitizing dyes as described in Japanese patent application (OPI) No. 111239/85.

These sensitizing dyes may be used singly or in combination. Such a combination of sensitizing dyes is often used for the purpose of supersensitization.

Besides the sensitizing dye, a dye which itself does not provide spectral sensitization, or a substance which does not substantially absorb visible light and shows supersensitization may be contained in the emulsion of the present invention (e.g., those described in U.S. Pat. Nos. 2,933,390, 3,635,721, 3,743,510, 3,615,641, 3,617,295 and 3,635,721).

The addition of such a sensitizing dye to the emulsion may be effected during, before and/or after chemical ripening. Alternatively, it may be before and/or after the formation of the nucleus of the silver halide particles in accordance with U.S. Pat. Nos. 4,183,756 and 4,225,666.

In general, the amount of the sensitizing dye to be added to the emulsion is from $10^{-8}$ to $10^{-2}$ mole based on mole of the silver halide.

The present invention employs an image forming substance which produces or releases a mobile dye corresponding or counter-corresponding to the reduction of a light-sensitive silver halide to silver at an elevated temperature, i.e., dye providing substance.

Such a dye providing substance will be further illustrated hereinafter.

Examples of the dye providing substance which may be used in the present invention include a coupler capable of reacting with a developer. In the process using a coupler, the oxidation-reduction reaction of a silver salt with a developer produces an oxide form of the developer which will then react with the coupler to form a dye. This process is described in a large number of literature documents. Specific examples of the developer and coupler are described in *The Theory of the*

*Photographic Process* (4th Ed.; edited by T. H. James; pp. 291–334 and pp. 354–361), and Japanese patent application (OPI) Nos. 123533/83, 149046/83, 149047/83, 111148/84, 124339/84, 174835/84, 231539/84, 231540/84, 2950/85, 2951/85, 14242/85, 23474/85, and 66249/85.

Another example of the dye providing substance is a dye-silver compound which is obtained by combining an organic silver salt with a dye. Specific examples of such a dye-silver compound are described in *Research Disclosure,* RD No. 16966 (May 1978, pp. 54–58).

Examples of the dye providing substance also include an azo dye for use in a heat development silver dye bleaching process. Specific examples of such an azo dye and such a bleaching process are described in U.S. Pat. No. 4,235,957 and *Research Disclosure,* RD No. 14433 (April 1976, pp. 30–32).

Examples of a dye providing substance further include a leuco dye as described in U.S. Pat. Nos. 3,985,565 and 4,022,617.

Another example of the dye providing substance is a compound which serves to release or diffuse a diffusive dye imagewise.

This type of a compound can be represented by formula ($L_1$)

$$(\text{Dye—X})_n\text{—Y} \qquad (L_1)$$

wherein Dye represents a dye group, or a dye group or dye precursor group which has temporarily been shifted to the short wavelength side in its absorption; X represents a mere bond or linking group; Y represents a group which makes the diffusibility of the compound of formula ($L_1$) different from each other corresponding or counter-corresponding to the light-sensitive silver salt having an imagewise latent image, or makes the diffusibility of $(\text{Dye—X})_n$—Y different from that of Dye released therefrom; and n represents an integer of 1 or 2, with the proviso that when n is 2, the two Dye—X are the same or different from each other.

Specific examples of the dye providing substance represented by formula ($L_1$) include a dye developer having a hydroquinone developer and a dye component combined to each other as described in U.S. Pat. Nos. 3,134,764, 3,362,819, 3,597,200, 3,544,545, and 3,482,972, a substance which releases a diffusible dye upon an intramolecular nucleophilic substitution reaction as described in Japanese patent application (OPI) No. 63618/76, and a substance which releases a diffusive dye upon an intramolecular rearrangement reaction of an iso-oxazolone ring as described in Japanese patent application (OPI) No. 111628/76. In any of these processes, a diffusible dye is released or diffused in portions which do not undergo development, but is neither released nor diffused in portions which undergo development.

In another process, a dye providing substance is converted to an oxide form which is not capable of releasing a dye, and the oxide form is allowed to be present with a reducing agent or its precursor. After development, the oxide form of the dye providing substance is reduced by the reducing agent which has been left unoxidized to release a diffusible dye. Specific examples of the dye providing substance which may be used in the above process are described in Japanese patent application (OPI) Nos. 110827/78, 130927/79, 164342/81, and 35533/78.

On the other hand, examples of a substance which allows developed portions to release a diffusible dye include a substance which causes release of a diffusible dye upon reaction of a coupler containing the diffusible dye in a coupling-off group with an oxide form of a developer as described in British Pat. No. 1,330,524, Japanese patent publication No. 39165/73, and U.S. Pat. No. 3,443,940.

In these processes using a color developer, contamination of the image by the oxidation-decomposition product of developer causes a serious problem. In order to solve this problem, a dye providing substance which needs no developer and has reducing power itself has been proposed. Typical examples of such a dye providing substance include those as described in U.S. Pat. Nos. 3,928,312, 4,053,312, 4,055,428, and 4,336,322, Japanese patent application (OPI) Nos. 65839/84, 69839/84, 3819/78, and 104343/76, Research Disclosure, RD No. 17465, U.S. Pat. Nos. 3,725,062, 3,728,113, and 3,443,939, Japanese patent application (OPI) Nos. 116537/83 and 179840/82, and U.S. Pat. No. 4,500,626.

Specific examples of the dye providing substance which may be used in the present invention include compounds as described in U.S. Pat. No. 4,500,626. In particular, compounds (1) to (3), (10) to (13), (16) to (19), (28) to (30), (33), (35), (38) to (40), and (42) to (64) described in the above U.S. Patent are preferably used. Compounds as described in Japanese patent application (OPI) No. 124941/86 may be preferably used.

The dye providing substance is generally used in an amount of from 0.01 to 4 mole, preferably from 0.05 to 3 mole based on mole of silver.

The incorporation of the above dye providing substances and hydrophobic additive such as image formation accelerators described hereinafter into layers of the light-sensitive material of the present invention may be accomplished by any suitable method as described in U.S. Pat. No. 2,322,027. In this case, a high boiling point organic solvent as described in Japanese patent application (OPI) Nos. 83154/84, 178451/84, 178452/84, 178453/84, 178454/84, 178455/84, and 187457/84 may be used optionally in combination with a low boiling point organic solvent having a boiling point of from 50° to 160° C.

The amount of the high boiling organic solvent to be used is 10 g or less, preferably 5 g or less based on 1 g of dye providing substance.

A dispersion process by using a polymer as described in Japanese patent publication Nos. 39853/76 and 59943/76 may be used.

If a substantially water-insoluble compound is used, a dispersion process other than the above process may be used. For example, such a compound may be finely dispersed in a binder. When a hydrophobic substance is dispersed in a hydrophilic colloid, various surface active agents may be used. As such surface active agents, those described in Japanese patent application (OPI) No. 157636/84 may be used.

In the present invention, a reducing substance is preferably incorporated in the light-sensitive material. Examples of such a reducing substance include those commonly known as reducing agents and the previously mentioned dye providing substances having reducing power. Another example of such a reducing substance is a reducing agent precursor which does not have reducing power itself but provides reducing power when acted upon by a nucleophilic reagent or heat in the development process.

Examples of reducing agents which may be used in the present invention are described in U.S. Pat. Nos. 4,500,626 and 4,483,914, and Japanese patent application (OPI) Nos. 140335/85, 128438/85, 128436/85, 128439/85, and 128437/85. Furthermore, reducing agent precursors as described in Japanese patent application (OPI) Nos. 138736/81 and 40245/82 and U.S. Pat. No. 4,330,617 may be used.

Combinations of various developers as described in U.S. Pat. No. 3,039,869 may be used.

In the present invention, the amount of the reducing agent to be incorporated is preferably from 0.01 to 20 mole, more preferably from 0.1 to 10 mole based on mole of silver.

The light-sensitive material of the present invention may comprise an image formation accelerator. The image formation accelerator serves to accelerate the oxidation-reduction reaction of the silver salt oxidizing agent with the reducing agent, reactions such as production of dye from the dye providing substance, decomposition of a dye, and release of a mobile dye, and transfer of the dye from the layer of the light-sensitive element to the dye fixing layer. From a physiochemical standpoint, the image formation accelerator is classified into the previously mentioned base or base precursor, nucleophilic compound, high boiling point organic solvent (oil), heat solvent, surface active agent, and compound having interaction with silver or silver ions. However, these substance groups generally have composite functions and thus have combinations of the above acceleration effects.

The details of image formation accelerators are described in Japanese patent application (OPI) No. 147244/86.

In the present invention, various development stopping agents may be used in order to stabilize image quality against fluctuation of processing temperature and time during development.

The term "development stopping agent" as used herein means a compound which rapidly neutralizes or reacts with a base to lower the concentration of base in the layer so that development is stopped, or a compound which interacts with silver and a silver salt to suppress development. Specific examples of such a compound include an acid precursor which releases an acid upon heating, an electrophilic compound which undergoes a substitution reaction with a base present therewith upon heating, a nitrogen-containing heterocyclic compound, a mercapto compound, and their precursors (e.g., compounds described in Japanese patent application (OPI) Nos. 192939/85, 230133/85 and 230134/85).

Compounds which release a mercapto compound upon heating may be preferably used. Examples of such a compound are described in Japanese patent application (OPI) Nos. 147244/86 and 124941/86.

In the present invention, the light-sensitive material may comprise a compound which serves to stabilize the image as well as activate development. Specific examples of such a compound which may be preferably used in the present invention are described in U.S. Pat. No. 4,500,626.

In the present invention, various antifoggants may be used. As such an antifoggant there may be used azole, carboxylic acid and phosphoric acid containing nitrogen atoms as described in Japanese patent application (OPI) No. 168442/84, or mercapto compounds or their metal salts as described in Japanese patent application (OPI) No. 111636/84.

In the present invention, the light-sensitive material may optionally comprise toning agent. Specific examples of the toning agent are described in Japanese patent application (OPI) No. 147244/86.

The binders to be used in the light-sensitive element and the dye fixing element of the present invention may be used singly or in combination. Typical examples of hydrophilic binders which can be used in the present invention include transparent or opaque hydrophilic binders. Specific examples of such a binder include proteins such as gelatin, gelatin derivatives and cellulose derivatives, natural substances such as polysaccharides (e.g., starch and gum arabic), and synthetic polymerized substances such as water-soluble polyvinyl compounds, e.g., polyvinyl pyrolidone and acrylamide polymer. Other synthetic polymerized substances include a dispersed polyvinyl compound in the form of latex which particularly serves to add to dimensional stability of photographic materials.

In the present invention, the amount of the binder to be applied is generally 20 $g/m^2$ or less, preferably 10 $g/m^2$ or less, more preferably 7 $g/m^2$ or less.

The amount of the high boiling point organic solvent to be dispersed in the binder together with the hydrophobic compound such as the dye providing substance is generally 1 cc or less, preferably 0.5 cc or less, more preferably 0.3 cc or less based on 1 g of binder.

The light-sensitive element and the dye fixing element of the present invention may contain an inorganic or organic hardener other than the epoxy hardener of the present invention in the photographic emulsion layer and other binder layers.

Specific examples of such hardeners include those as described in Japanese patent application (OPI) Nos. 147244/86 and 157636/84. These compounds may be used singly or in combination.

The support to be used in the light-sensitive element and the dye fixing element of the present invention is required to withstand the processing temperature. As such a support there may be used those described as a support in Japanese patent application (OPI) No. 147244/86 as well as glass, paper, polymer film, metal and their analogous.

If the light-sensitive material to be used in the present invention contains a colored dye providing substance, it is not so necessary that the light-sensitive material further contain an anti-irradiation or antihalation substance or various dyes. However, such a light-sensitive element may contain filter dyes or absorbing substances described in Japanese patent application (OPI) No. 147244/86 and U.S. Pat. No. 4,500,626.

In order to obtain a wide range of colors in the chromaticity diagram using the three primary colors (yellow, magenta, and cyan), the light-sensitive element to be used in the present invention is required to have at least three silver halide emulsion layers having a sensitivity in different spectral regions.

Typical examples of combinations of three light-sensitive silver halide emulsion layers having a sensitivity in different spectral regions are described in Japanese patent application (OPI) No. 180550/84.

The light-sensitive element to be used in the present invention may optionally have two or more layers of an emulsion having a sensitivity in the same spectral region depending on the sensitivity of the emulsion.

The light-sensitive material to be used in the present invention may optionally comprise various conventional additives for heat-developable light-sensitive materials, or layers other than the light-sensitive layer, such as, an antistatic layer, an electrically-conductive layer, a protective layer, an intermediate layer, an antihalation layer, a peeling off layer, and a matting layer. Examples of various additives are described in *Research Disclosure,* RD No. 17029 (Vol. 170, June 1978) and Japanese patent application (OPI) No. 88256/86. Specific examples of these additives include plasticizers, sharpness improving dyes, antihalation dye, sensitizing dyes, matting agents, surface active agents, fluorescent whitening agents, ultraviolet absorbers, smoothing agents, antioxidants, and discoloration inhibitors.

In particular, it is used that the protective layer contains an organic or inorganic matting agent to prevent adhesion or sticking of the layers. Alternatively, the protective layer may contain a mordant, an ultraviolet ray absorber or the like. The protective layer and the intermediate layer each may comprise two or more layers.

The intermediate layer may contain a reducing agent to prevent color stain. The intermediate layer may also contain an ultraviolet ray absorber and a white pigment such as $TiO_2$. Such a white pigment also may be incorporated into the emulsion layer to increase sensitivity.

The dye fixing element of the present invention comprises at least one layer containing a mordant. If the dye fixing element is disposed at the top surface, it may be optionally further provided with a protective layer thereon.

With respect to layer configuration of the dye fixing element and the process for incorporation and disposition of binder, additive and mordant, those as described in Japanese patent application (OPI) No. 147244/86 can be applied to the present invention.

The dye fixing element to be used in the present invention may optionally comprise an auxiliary layer such as peeling off layer, matting layer, and anticurling layer besides the above mentioned layers.

The above one or plurality of layers may contain a base and/or base precursor for accelerating the transfer of dye, a hydrophilic heat solvent, a discoloration inhibitor for preventing discoloration of dye, an ultraviolet ray absorber, a slipping agent, a matting agent, an antioxidant, a dispersed vinyl compound for increasing dimensional stability, a fluorescent whitening agent, or the like. Specific examples of these additives are described in *Research Disclosure,* RD No. 1702 (Vol. 170, June 1978) and Japanese patent application (OPI) No. 88256/86.

The binder to be contained in the above layers is preferably hydrophilic. Typical examples of such a hydrophilic binder include the previously mentioned transparent or opaque hydrophilic colloid.

Examples of the image receiving layer used in the present invention include a dye fixing layer to be used in a heat-developable color light-sensitive material, which dye fixing layer contains mordants which are commonly used. Particularly preferred among these mordants is a polymer mordant. Examples of such a polymer mordant include a polymer containing a tertiary amino group, a polymer containing a nitrogen-containing heterocyclic portion, and a polymer containing a quarternary cation group thereof.

Specific examples of these polymers are described in Japanese patent application (OPI) No. 147244/86 and U.S. Pat. No. 4,500,626.

As mordant for the dye fixing material of the present invention, a polymer mordant obtained by copolymerizing a monomer containing a sulfinic acid group with a monomer having a mordanting group as described in Japanese patent application (OPI) No. 118834/85 may be used. If such a polymer mordant is used, the speed of development/transfer or transfer can be increased and density of transferred image and hue of transferred image can be improved.

With respect to coating of the heat-developable light-sensitive layers, protective layers, intermediate layers, undercoat layers, backing layers, and other layers, processes as described in U.S. Pat. No. 4,500,626 can be used.

As a light source to which the heat developable light-sensitive material is imagewise exposed to record images thereon there may be used radiation including visible light. For example, light sources as described in Japanese patent application (OPI) No. 147244/86 and U.S. Pat. No. 4,500,626 can be used.

The heating process in the present invention is preferably effected at a temperature of about 50° C. to about 250°0 C., more preferably about 80° C. to about 180° C. The transfer process can be effected at a temperature ranging from that required for heat development to room temperature, more preferably from 60° C. to a temperature about 10° C. below that required for heat development. As a heating means required for development and/or the transfer process there may be employed a heating plate, an iron, a heating roller, or a heating element made of carbon or titanium white.

As described in Japanese patent application (OPI) No. 218443/84, development and transfer may be effectively carried out simultaneously or in succession. In this process, the previously mentioned image formation accelerator may be previously incorporated in either or both of the dye fixing element and the light-sensitive element or may be supplied from outside. In this process, the heating temperature is preferably from 60° C. to a temperature below the boiling point of a transfer solvent such as a dye transfer assistant. For example, if the transfer solvent is water, the heating temperature is preferably from 60° C. to 100° C. The amount of water used in the present invention is at least 0.1 time the total weight of the coated layer of the light-sensitive element and that of the dye fixing element, preferably in the range of from 0.1 time the total weight of the coated layer to the weight of wter corresponding to the maximum swelling volume of the entire coated layer, more preferably in the range of 0.1 time the total weight of the coated layer to the amount obtained by subtracting the weight of the entire coated layer from the weight of water corresponding to the maximum swelling volume of the entire coated layer.

When swollen, the layer tends to be unstable. Some conditions cause a local stain. In order to avoid this trouble, water is preferably used in an amount less than the amount of water corresponding to the maximum swelling volume of the entire coated layer of the light-sensitive element and the dye fixing element as described above.

In the present invention, if the dye providing substance which releases a mobile dye imagewise is used, transfer of the dye from the light-sensitive layer to the dye fixing layer can be accomplished by the use of a dye transfer assistant.

If the dye transfer assistant is supplied from outside, there may be used as such a dye transfer assistant water, sodium hydroxide, potassium hydroxide, or a basic aqueous solution containing an inorganic alkali metal salt and an organic base. As such a base, those as described with reference to image formation accelerator may be used. Alternatively, low boiling solvents such as methanol, N,N-dimethylformamide, acetone, and diisobutyl ketone or a mixture of these low boiling solvents and water or basic aqueous solutions may be used. Such a dye transfer assistant can be applied by wetting either or both of the dye fixing material and the light-sensitive material therewith.

Such a dye transfer assistant (e.g., water) serves to accelerate transfer to the image by being provided between the light-sensitive layer in the light-sensitive element and the dye fixing layer in the dye fixing element. Alternatively, such a dye transfer assistant may be previously provided to either or both of the light-sensitive layer and the dye fixing layer, and then the two layers may then be laminated with each other.

The incorporation of the dye transfer assistant in the light-sensitive layer or the dye fixing layer can be accomplished by any suitable method as described in Japanese patent application (OPI) No. 147244/86.

In order to accelerate the dye transfer, a hydrophilic heat solvent which is solid at normal temperature but melts at an elevated temperature may be incorporated into the light-sensitive element or the dye fixing element. Such a hydrophilic heat solvent may be incorporated in either or both of the light-sensitive element and the dye fixing element. The heat solvent may be incorporated in any of an emulsion layer, an intermediate layer, a protective layer, and a dye fixing layer, preferably a dye fixing layer and/or its adjacent layers.

Examples of such a hydrophilic heat solvent include ureas, pyridines, amides, sulfonamides, imides, alcohols, oximes, and other heterocyclic compounds.

Examples of a heating means required for the transfer process are described in Japanese patent application (OPI) No. 147244/86. Alternatively, the dye fixing element may have a layer of an electrically-conductive material such as graphite, carbon black and metal, so that the dye fixing element can be directly heated upon passage of current through the electrically-conductive layer.

With respect to the method for applying pressure required for lamination and adhesion of the heat developable light-sensitive material to the dye fixing material and the condition thereof, processes as described in Japanese patent application (OPI) No. 147244/86 can be used.

The present invention will be further illustrated in the following examples, but the present invention should not be construed as being limited thereto.

Unless otherwise specified, all ratios, percents, etc. are by weight.

EXAMPLE 1

Preparation of Benzotriazole Silver Emulsion 28 g of gelatin and 13.2 g of benzotriazole were dissolved in 300 ml of water. The solution thus obtained was then stirred with the temperature thereof kept at 40° C. A solution obtained by dissolving 17 g of silver nitrate in 100 ml of water was added to the above-prepared solution over two minutes.

The pH of the benzotriazole silver emulsion thus obtained was adjusted to undergo precipitation so that excess salt was removed. Thereafter, the pH of the emulsion was adjusted to 6.30. As a result, 400 g of a benzotriazole silver emulsion was obtained.

Preparation of Silver Halide Emulsion for 5th and 1st Layers 600 ml of an aqueous solution containing sodium chloride and potassium bromide and an aqueous solution of silver nitrate obtained by dissolving 0.59 mole of silver nitrate in 600 ml of water were simultaneously added to an aqueous solution of gelatin (containing 20 g of gelatin and 3 g of sodium chloride in 1,000 ml of water and kept at a temperature of 75° C. under stirring) at the same flow rate over 40 minutes. Thus, a monodisperse emulsion of cubic silver chlorobromide particles having an average particle size of 0.40 μm (bromide: 50 mol%) was prepared.

After washing and desalting, 5 mg of sodium thiosulfate and 20 mg of 4-hydroxy-6-methyl-1,3,3a,7-tetrazaindene were added to the monodisperse emulsion, and the emulsion then underwent chemical sensitization at a temperature of 60° C. The yeild of the emulsion thus sensitized was 600 g.

Preparation of Silver Halide Emulsion for 3rd Layer 600 ml of an aqueous solution containing sodium chloride and potassium bromide and an aqueous solution of silver nitrate obtained by dissolving 0.59 mole of silver nitrate in 600 ml of water were simultaneously added to an aqueous solution of gelatin (containing 20 g of gelatin and 3 g of sodium chloride in 1,000 ml of water and kept at a temperature of 75° C. under stirring) at the same flow rate over 40 minutes. Thus, a monodisperse emulsion of cubic silver chlorobromide particles having an average particle size of 0.35 μm (bromide: 80 mole%) was prepared.

After washing and desalting, 5 mg of sodium thiosulfate and 20 mg of 4-hydroxy-6-methyl-1,3,3a,7-tetrazaindene were added to the monodisperse emulsion, and the emulsion then underwent chemical sensitization at a temperature of 60° C. The yield of the emulsion thus sensitized was 600 g.

Preparation of Gelatin Dispersion of Dye Providing Substance 5 g of Yellow Dye Providing Substance (A), 0.5 g of sodium sulfonate-2-ethylhexylester succinate as a surface active agent, and 10 g of triisononyl phosphate were added to 30 ml of ethyl acetate. The admixture was heated to a temerature of about 60° C. so as to make a uniform solution. The solution thus obtained was then mixed with 100 g of a 10% aqueous solution of lime-treated gelatin with stirring. The admixture was subjected to dispersion at 10,000 rpm by means of a homogenizer for 10 minutes. The dispersion thus prepared was referred to as a dispersion of Yellow Dye Providing Substance (A).

A dispersion of Magenta Dye Providing Substance (B) was prepared in the same manner as used for the above dispersion of Yellow Dye Providing Substance (A) except that Magenta Dye Providing Substance (B) was used and 7.5 g of tricresyl phosphate was used as a high boiling point solvent.

A dispersion of Cyan Dye Providing Substance (C) was prepared in the same manner as used for the dispersion of Yellow Dye Providing Substance (A) except that Cyan Dye Providing Substance (C) was used.

Using these emulsions and dispersions, multilayered color Light-Sensitive Element A was prepared as shown below.

6th layer:
- gelatin (coated amount: 800 mg/m$^2$),
- hardener (*3) (coated amount: 16 mg/m$^2$),
- silica (*5) (coated amount: 100 mg/m$^2$)

5th layer: Green-sensitive emulsion layer:
- silver chlorobromide emulsion (bromide: 50 mole%, coated amount: 400 mg/m$^2$ as silver,)
- benzenesulfonamide (coated amount: 180 mg/m$^2$),
- benzotriazole silver emulsion (coated amount: 100 mg/m$^2$ as silver),
- Sensitizing Dye D-1 (coated amount: $10^6$ mole/m$^2$),
- hardener (*3) (coated amount: 16 mg/m$^2$),
- Yellow Dye Providing Substance (A) (coated amount: 400 mg/m$^2$),
- gelatin (coated amount: 1,000 mg/m$^2$),
- high boiling point solvent (*4) (coated amount: 800 mg/m$^2$),
- surface active agent (*2) (coated amount: 100 mg/m$^2$), 4th layer: Intermediate layer:
- gelatin (coated amount: 900 mg/m$^2$),
- hardener (*3) (coated amount: 18 mg/m$^2$), 3rd layer: Red sensitive emulsion layer:
- silver chlorobromide emulsion (bromide: 80 mole%, coated amount: 300 mg/m$^2$ as silver),
- benzenesulfonamide (coated amount: 180 mg/m$^2$),
- benzotriazole silver emulsion (coated amount: 100 mg/m$^2$ as silver),
- Sensitizing Dye D-2 ($8\times10^7$ mole/m$^2$),
- hardener (*3) (coated amount: 18 mg/m$^2$),
- Magenta Dye Providing Substance (B) (coated amount: 400 mg/m$^2$),
- gelatin (coated amount: 1,000 mg/m$^2$),
- high boiling point solvent (*1) (coated amount: 600 mg/m$^2$),
- surface active agent (*2) (coated amount: 100 mg/m$^2$), 2nd layer: Intermediate layer:
- gelatin (coated amount: 800 mg/m$^2$),
- hardener (*3) (coated amount: 16 mg/m$^2$), 1st layer: Infrared sensitive emulsion layer:
- silver chlorobromide emulsion (bromide: 50 mole%, coated amount: 300 mg/m$^2$ as silver),
- benzenesulfonamide (coated amount: 180 mg/m$^2$),
- benzotriazole silver emulsion (coated amount: 100 mg/m$^2$ as silver),
- Sensitizing Dye D-3 (coated amount: $10^8$ mole/m$^2$),
- hardener (*3) (coated amount: 16 mg/m$^2$),
- Cyan Dye Providing Substance (C) (coated amount: 300 mg/m$^2$),
- gelatin (coated amount: 1,000 mg/m$^2$),
- high boiling point solvent (*4) (coated amount: 600 mg/m$^2$),
- surface active agent (*2) (coated amount: 100 mg/m$^2$), Support

*1: tricresyl phosphate

*2: $C_9H_{19}$— 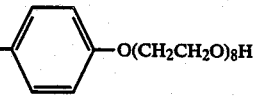 —$O(CH_2CH_2O)_8H$

*3: 2,4-dichloro-6-hydroxy-1,3,5-triazine

*4: $(isoC_9H_{19}O)_2P{=}O$

*5: size 4 μm

Yellow Dye Providing Substance (A)

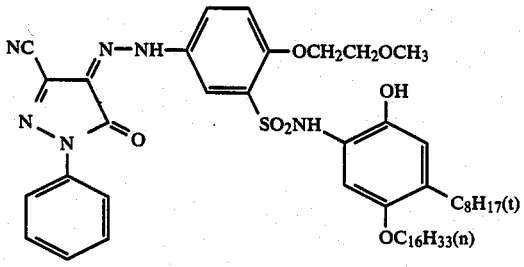

-continued

Magenta Dye Providing Substance (B)

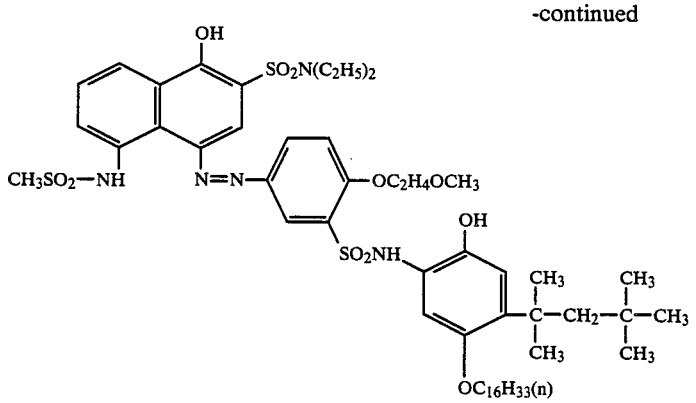

Cyan Dye Providing Substance (C)

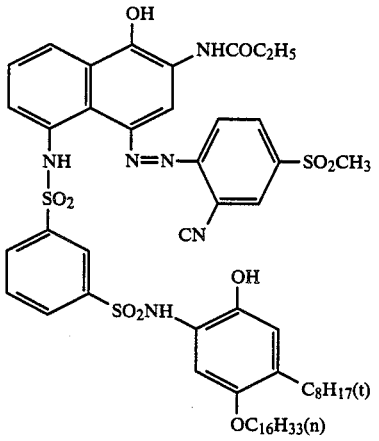

Sensitizing Dye (D-1)

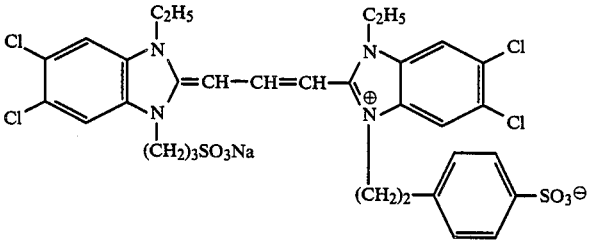

Sensitizing Dye (D-2)

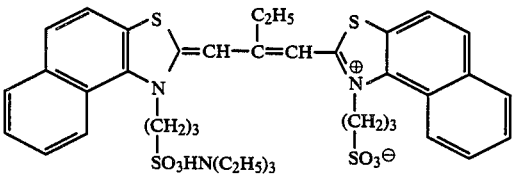

Sensitizing Dye (D-3)

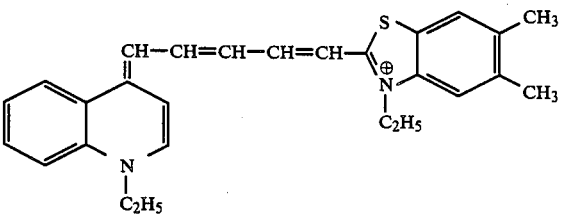

Preparation of Dye Fixing Element 63 g of gelatin and 130 g of a mordant having the structural formula shown below are dissolved in 1,300 ml of water. The solution thus obtained was then applied to a paper support laminated with a polyethylene in an amount such that the thickness of wet layer reached 42 μm. The wet film thus formed was then dried.

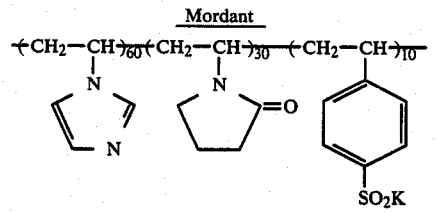

A solution obtained by adding 8 ml of a 2% aqueous solution of 2,4-dichloro-6-hydroxy-s-triazine to an aqueous solution obtained by dissolving 35 g of gelatin and 113 g of sodium metaborate tetrahydrate in 800 ml of water was applied to the layer thus formed in an amount such that the thickness of wet layer reached 17 μm, and then dried to prepare Dry Fixing Element D-1.

On the other hand, Dye Fixing Elements D-2 to D-4 were prepared in the same manner as used for Dye Fixing Element D-1 except in that equimolar amounts of the epoxy hardeners shown in Table 1 were used instead of 2,4-dichloro-6-hydroxy-s-triazine as an active halogen hardener.

The multilayered color light-sensitive elements thus obtained were exposed to light of 500 lux from a tungsten lamp through a separation filter (G: 500–600 nm; 600–700 nm; IR: 700 nm or more) for 1 second.

Water was supplied to the emulsion surface of the light-sensitive element thus exposed by means of a wire bar in an amount of 20 ml/m$^2$. Thereafter, Dye Fixing Elements D-1, D-2, D-3 or D-4 was superimposed on each other in such a manner that the film surfaces thereof were brought into contact with each other. The lamination was heated for 15 or 20 seconds by means of a heat roller which had been controlled so as to maintain the temperature of the layer thus absorbed water at 90° to 95° C. The dye fixing element was then peeled off the light-sensitive element. As a result, there were obtained on the dye fixing element sharp images of yellow (Y), magenta (M), and cyan (C) corresponding to the separation filter (G, R, and IR). These images were measured for maximum color density (Dmax) and minimum color density (Dmin) by a Macbeth reflection densitometer (RD-519). The results are shown in Table 1.

TABLE 1

| Dye fixing element | Hardener | Color image | 15 sec. heating Dmax | 15 sec. heating Dmin | 20 sec. heating Dmax | 20 sec. heating Dmin |
|---|---|---|---|---|---|---|
| D-1 (comparative | Active halogen type | Y | 0.62 | 0.20 | 1.42 | 0.25 |
| | | M | 0.59 | 0.19 | 1.39 | 0.27 |
| | | C | 0.74 | 0.16 | 1.53 | 0.20 |
| D-2 (present invention) | (29) (p=4) | Y | 1.70 | 0.20 | 2.25 | 0.21 |
| | | M | 1.73 | 0.19 | 2.28 | 0.20 |
| | | C | 1.80 | 0.18 | 2.34 | 0.20 |
| D-3 (present invention) | (3) (p=2) | Y | 1.65 | 0.19 | 2.10 | 0.20 |
| | | M | 1.68 | 0.18 | 2.15 | 0.18 |
| | | C | 1.70 | 0.16 | 2.20 | 0.19 |
| D-4 (present invention) | (29) (p=2) | Y | 1.63 | 0.17 | 2.05 | 0.18 |
| | | M | 1.65 | 0.18 | 2.10 | 0.19 |
| | | C | 1.68 | 0.18 | 2.15 | 0.20 |

As can be seen from Table 1, the use of the dye fixing elements using the epoxy hardener of the present invention can provide excellent color images of lower Dmin and higher Dmax in a short period of time as compared to the comparative sample (D-1).

Furthermore, after being kept at a temperature of 50° C. and a relative humidity of 80% for 7 days, Dye Fixing Elements D-1to D-4 were subjected to the same development/transfer process. As a result, the dye fixing layer peeled off in D-1. However, no such trouble was observed in D-2 to D-4. These specimens D-2 to D-4 maintained surface gloss.

EXAMPLE 2

Light-Sensitive Element B was prepared in the same manner as used in Light-Sensitive Element A of Example 1 except that 0.5 g/m$^2$ of a dispersion of a basic zinc carbonate was incorporated into the 4th layer (intermediate layer) and the 2nd layer (intermediate layer).

Dye Fixing Element D-5 (comparative example) and Dye Fixing Element D-6 (present invention) each containing the hardeners as mentioned in Table 2 were prepared in the same manner as in Example 1 except that carbonate of guanidine was replaced by 2.0 g/m$^2$ of guanidium picrate.

The same process as used in Example 1 was conducted using Dye Fixing Elements D-5 and D-6 and Light-Sensitive Element B.

The results are shown in Table 2.

TABLE 2

| Dye fixing element | Hardener | Color image | 20 sec. heating Dmax | 20 sec. heating Dmin | 30 sec. heating Dmax | 30 sec. heating Dmin |
|---|---|---|---|---|---|---|
| D-5 (comparative) | Active halogen | Y | 0.97 | 0.20 | 1.59 | 0.23 |
| | | M | 0.93 | 0.18 | 1.80 | 0.21 |
| | | C | 0.83 | 0.17 | 1.67 | 0.20 |
| D-6 (present invention) | (29) (p=4) | Y | 1.95 | 0.22 | 2.13 | 0.28 |
| | | M | 1.98 | 0.21 | 2.20 | 0.25 |
| | | C | 2.02 | 0.20 | 2.35 | 0.22 |

As can be seen from Table 2, the dye fixing element using the epoxy hardener of the present invention can provide excellent images of lower Dmin and higher Dmax for a short process as compared to the comparative sample D-5.

While the invention has been described in detail and with reference to specific embodiments thereof, it will be apparent to one skilled in the art that various changes and modifications can be made therein without departing from the spirit and scope thereof.

What is claimed is:

1. A process for forming an image comprising imagewise exposing a light-sensitive element comprising a support having thereon at least a light-sensitive silver halide, a binder, and a dye providing substance which produces or releases a mobile dye corresponding or counter-corresponding to a reaction where said light-sensitive silver halide is reduced to silver at an elevated temperature, and subsequently or simultaneously heating said light-sensitive element in the presence of at least one of a base and precursor thereof, and thereby transferring said mobile dye thus produced or released to a dye fixing element, wherein a coated layer of said dye fixing element has been hardened with a epoxy hardener.

2. A process for forming an image as in claim 1, wherein said epoxy hardener is a compound represented by formula (I)

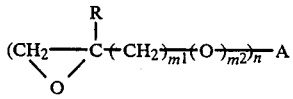

(I)

wherein R represents a hydrogen atom or a lower alkyl group; $m^1$ and $m^2$ each represents an integer of 0 or 1; n represents an integer of from 2 to 4; when n is 2, A represents a mere bond or a group having a valency of 2; and when n is 3 or 4, A represents a group having a valency of n.

3. A process for forming an image as in claim 2, wherein R in formula (I) represents a hydrogen atom.

4. A process for forming an image as in claim 1, wherein the amount of said epoxy hardener is in the range of from 0.01 to 20% by weight based on the amount of said binder.

5. A process for forming an image as in claim 4, wherein the amount of said epoxy hardener is in the range of from 0.1 to 10% by weight based on the amount of said binder.

6. A process for forming an image as in claim 1, wherein said base has a pKa of 8 or more.

7. A process for forming an image as in claim 1, wherein said base is a salt of an organic base and a weak acid.

8. A process for forming an image as in claim 1, wherein said at least one of a base and precursor thereof is present in at least one of said light-sensitive element and said dye fixing element, the amount of said at least one of a base and precursor thereof in said light-sensitive element is 50% by weight or less based on the amount of the coated layer of said light-sensitive element, and the amount of said at least one of a base and precursor thereof in said dye fixing element is 50% by weight or less based on the amount of the coated layer of said dye fixing element.

9. A process for forming an image as in claim 8, wherein said at least one of a base and a precursor thereof is present in at least one of said light-sensitive element and said dye fixing element, the amount of said at least one of a base and precursor thereof in said light-sensitive element is in the range of from 0.01 to 40% by weight based on the amount of the coated layer of said light-sensitive element, and the amount of said at least one of a base and precursor thereof in said dye fixing element is in the range of from 0.01 to 40% by weight based on the amount of the coated layer of said dye fixing element.

10. A process for forming an image as in claim 1, wherein said at least one of a base and precursor thereof is present in a form of dissolved in water having a concentration of from 0.005 to 2 mole/l.

11. A process for forming an image as in claim 10, wherein said at least one of a base and precursor thereof is present in a form of dissolved in water having a concentration of from 0.05 to 1 mole/l.

12. A process for forming an image as in claim 1, wherein said light-sensitive element further comprises at least one of an organic silver salt oxidizing agent and a reducing agent.

13. A process for forming an image as in claim 1, wherein the light-sensitive layer of said light-sensitive element and the dye fixing layer of said dye fixing element are provided on the same support.

14. A process for forming an image as in claim 1, wherein the light-sensitive layer of said light-sensitive element and the dye fixing layer of said dye fixing element are provided on the different supports.

15. A process for forming an image as in claim 1, wherein the coated amount of said light-sensitive silver halide is in the range of from 1 $mg/m^2$ to 10 $g/m^2$ as calculated in terms of amount of silver.

16. A process for forming an image as in claim 1, wherein the coated amount of said binder is 20 $g/m^2$ or less.

17. A process for forming an image as in claim 16, wherein the coated amount of said binder is 10 $g/m^2$ or less.

18. A process for forming an image as in claim 17, wherein the coated amount of said binder is 7 $g/m^2$ or less.

19. A process for forming an image as in claim 1, wherein the temperature of said heating step is in the range of from 50° to 250° C.

20. A process for forming an image as in claim 19, wherein the temperature of said heating step is in the range of from 80° to 180° C.

* * * * *